United States Patent [19]

Schwartz

[11] Patent Number: 4,627,618

[45] Date of Patent: Dec. 9, 1986

[54] AEROBIC HAND WEIGHTS

[76] Inventor: Leonard Schwartz, 5526 Northumberland St., Pittsburgh, Pa. 15217

[21] Appl. No.: 470,621

[22] Filed: Feb. 28, 1983

Related U.S. Application Data

[63] Continuation-in-part of Ser. No. 413,807, Sep. 1, 1982, abandoned, which is a continuation-in-part of Ser. No. 127,474, Mar. 5, 1980, Pat. No. 4,351,526.

[51] Int. Cl.[4] ..... A63B 11/00

[52] U.S. Cl. ..... 272/122; 272/119

[58] Field of Search ..... 272/93, 67, 68, 116, 272/117, 122, 143, DIG. 9, 119, 123, 124, 141; 273/165

[56] References Cited

U.S. PATENT DOCUMENTS

| | | | |
|---|---|---|---|
| D. 273,030 | 3/1984 | Anderson | D21/197 |
| 734,062 | 7/1903 | Harris | 272/122 |
| 742,393 | 10/1903 | Chellis et al. | 272/68 |
| 1,672,944 | 6/1928 | Jowett | 272/122 |
| 3,109,653 | 11/1963 | Biggs | 273/165 |
| 3,227,455 | 1/1966 | Hulsman | 273/165 |
| 4,105,200 | 8/1978 | Unger | 272/143 |
| 4,351,526 | 9/1982 | Schwartz | 272/122 |

FOREIGN PATENT DOCUMENTS

| | | | |
|---|---|---|---|
| 550961 | 2/1943 | United Kingdom | 272/68 |

*Primary Examiner*—Richard J. Apley
*Assistant Examiner*—Robert W. Bahr
*Attorney, Agent, or Firm*—Buell, Ziesenheim, Beck & Alstadt

[57] ABSTRACT

An aerobic exercise hand weight structure is provided particularly adapted for aerobic and related extended-time type exercises having an elongate body member with a soft, resilient central hand portion, and a hand engaging member resiliently connected at each end of the body member, said hand engaging member extending outwardly transversely to the body member and then generally parallel thereto to pass around the back of the hand preferably between the knuckles and wrist of a user to hold the hand resiliently between the central hand portion of the body member and the hand engaging member.

11 Claims, 7 Drawing Figures

AEROBIC HAND WEIGHTS

This application is a continuation-in-part of my copending application Ser. No. 413,807, filed Sept. 1, 1982, now abandoned, which was in turn a continuation-in-part of my Ser. No. 127,474, filed Mar. 5, 1980, now U.S. Pat. No. 4,351,526 issued Sept. 28, 1982.

This invention relates to aerobic hand weights and particularly to aerobic hand weights adapted for prolonged or extended use in aerobic exercises.

Dumbells have long been used for exercise purposes. In general, dumbbells forms heretofore available have been designed for use in arm, shoulder and chest development in a standing position. The dumbbells which have heretofore been available have been quite satisfactory for such purposes. Typical of such dumbbells are the conventional pair of rounded weights on opposite ends of a straight rod for gripping whose cross section is circular or slightly elliptical. There have been modifications of this conventional shape heretofore proposed to extend the usefulness of these devices to increase their effect on strengthening the muscles of the hands and fingers. Typical of such devices are those illustrated in U.S. Pat. Nos. 660,962; 742,393; 756,480, 734,062; 1,229,658 and 1,138,459. None of these devices, however is satisfactory for use in the correct performance of aerobic exercises in which hundreds or even thousands of repetitions of movement are involved as compared with the relatively few repetitions of conventional dumbbells.

Aerobic exercise has been found to be highly effective in adapting the body, particularly its heart muscle and skeletal muscles, to utilize oxygen at higher rates. Running, jogging and walking have accordingly achieved a new dimension in physical fitness regimens. The effectiveness of this training may be augmented to a surprising degree by loading the limbs of the person doing the exercise. Hand and leg weights serve this purpose well; however, the limiting factor in the use of conventional dumbbells is the gripping power of the hand which tends to fatigue more rapidly than the large muscle masses of the arms and legs. Aerobic exercises by their very nature are prolonged in duration, frequently extending over periods in excess of an hour. Thus, the limiting factor of gripping power is a very real and significant and limiting one for such exercises. Wrist weights have been proposed; however, the effective lever arm is lengthened by placing the weights in or on the hands. Moreover, the comfort factor is a real consideration, for wrist weights are frequently uncomfortable and tend to chafe the wearer. Weight gloves are a highly satisfactory means of adding the desired weight for aerobic exercise but are limited by inherent practicalities of glove size and comfort.

In order for a hand weight or dumbbells to be acceptable for use in aerobic exercises it must be:

(a) capable of supporting exercise of long duration;

(b) or prevent undue spasm of the arm and hand musculature by a soft, yet firm hand engaging means extending over the back of the hand;

(c) capable of releasing the hand muscles from the necessity and burden of gripping a dumbbell shaft continuously, so as to promote optimal circulation of blood, reduce the likelihood of untoward elevation of blood pressure and promote prolonged exercise;

(d) able to support the continuation of very rapid arm movements of extreme amplitude, including a succession of abrupt starts and stops which would be traumatic to skin, muscles, ligamentous and joint structure of the hand if not protected;

(e) permits the exerciser to determine his pulse count without removing the weight from the hand;

(f) suitable for all ambulatory exercises involving both arms and legs, i.e. walking and running; and (g) ensure the safe use of the dumbbell during exercise in which the hands attain an inordinately high velocity. During such exercise the antifugal force involved tends to cause the weight to be disengaged from the gripping hand, increases the exerciser's concern and effort and diminishes his freedom of motion.

I have invented a hand weight which is highly satisfactory for use in aerobic exercises. It satisfies all of the foregoing requirements. Its form is such that the hand can be relaxed periodically and the contant isometric contraction of the hand and forearm muscles, which is a severe limit in prolonged exercise with dumbbells, is reduced markedly. This relaxation serves to increase the blood flow to the gripping fingers and to reduce greatly the likelihood of the muscle spasm which frequently aborts such exercises prematurely when using conventional dumbbells and like weights.

I provide a hand weight having a generally cylindrical elongate hand portion, a hand engaging means engaged at each end of said hand portion, projecting outwardly and sidewise to pass around the back of a user's hand, preferably between the knuckles and wrist. The hand portion is covered with a soft, resilient member and may be contoured to conform generally to the shape of a user's hand and fingers when in the gripping position. The hand engaging means is attached to the hand portion and preferably extends generally transversely from the ends of the hand portion and parallel to the hand portion and is preferably padded over its length and resiliently connected to the ends of the hand portion. The hand portion may be made of a formed resilient plastic such as foam preferably, closed cell foam, having a central axial steel shaft extending therethrough and the hand engaging means may also be of formed resilient plastic such as foam, having a central axial steel shaft preferably of generally flattened C-shape not connected to the shaft of the hand portion except by the formed resilient plastic of the hand portion and/or the hand engaging portion. This provides a self adjustment not available in any prior structure and permits the hand to be relaxed during aerobic exercises.

In the foregoing general description I have set out certain objects, purposes and advantages of my invention. Other objects, purposes and advantages of this invention will be apparent from a consideration of the following description and the accompanying drawings in which.

Figure 1:
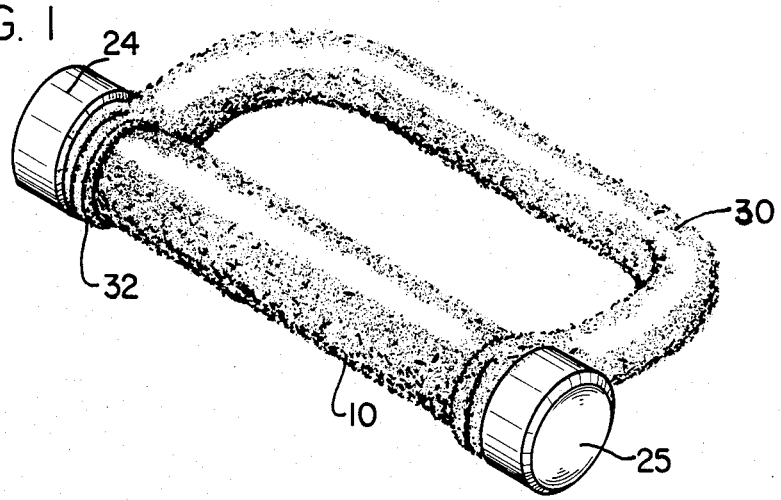
FIG. 1 is an isometric view of a preferred embodiment of this invention.
Figure 2:
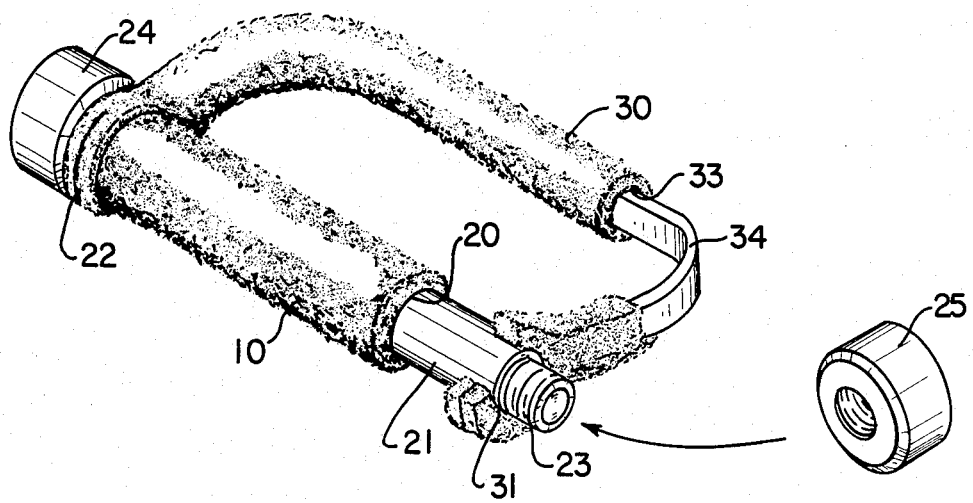
FIG. 2 is an isometric view of the embodiment of FIG. 1 partly cut away and exploded.

Referrring to the drawings, I have illustrated in FIGS. 1 and 2 one embodiment of hand weight according to this invention. In this embodiment, I provide a grip portion in the form of a generally cylindrical resilient foam rubber or plastic body 10 having an axial bore 20 therethrough receiving an elongate rod 21 threaded at each end 22 and 23 to receive generally cylindrical weights 24 and 25 having threaded openings 26 engaging threaded ends 22 and 23. A curved generally D-shaped dorsal hand strap 30 of foamed resilient rubber or plastic is provided having openings 31 and 32 at each end to pass ends 22 and 23 and a hollow bore 33 therethrough receiving a curved generally D-shaped metal rod 34. The rod 34 is not connected directly to rod 21 but is free to move away due to the resilience of strap 30. Strap 30 fits over the ends of rod 34 and is held in place by cylindrical weights 24 and 25. The parts can be of various sizes and assembled to suit a particular user so as to provide the proper amount of gripping action on the hand to permit their being used with the hand in fully relaxed position yet not apply so much pressure that blood pressure and/or ciruclation are in any way adversely affected.

Figure 3:
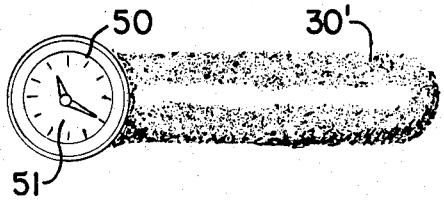
FIG. 3 is an end view of a modification of the apparatus of FIGS. 1 and 2.

In the embodiment illustrated in FIG. 3, the metal bar 21' of oval or round cross sections forms the grip portion covered with foam rubber or plastic 10' as in FIGS. 1–2, however, each end is hollow and provides a hollow enclosure portion 50 for carrying electronic circuitry or the like for use in connection with exercising. One might, for example, include timers 51, metronomes, work load calculators, etc. in said enclosure 50. Alternatively, the electronic circuitry could be placed in a hollow weight container such as parts 24 and 25 of FIGS. 1 and 2.

Figure 4:
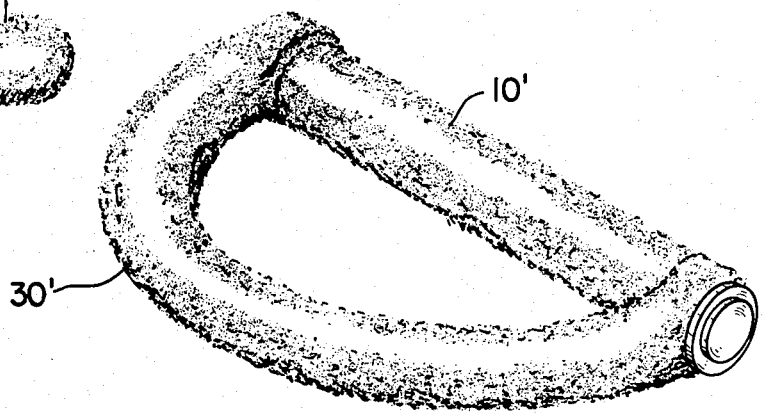
FIG. 4 is an isometric view of a third embodiment of this invention.
Figure 5:
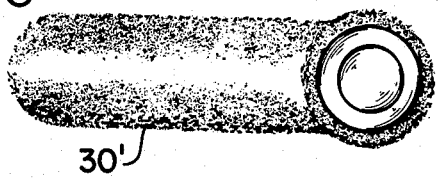
FIG. 5 is an end view of one end of the apparatus of FIG. 4.
Figure 6:
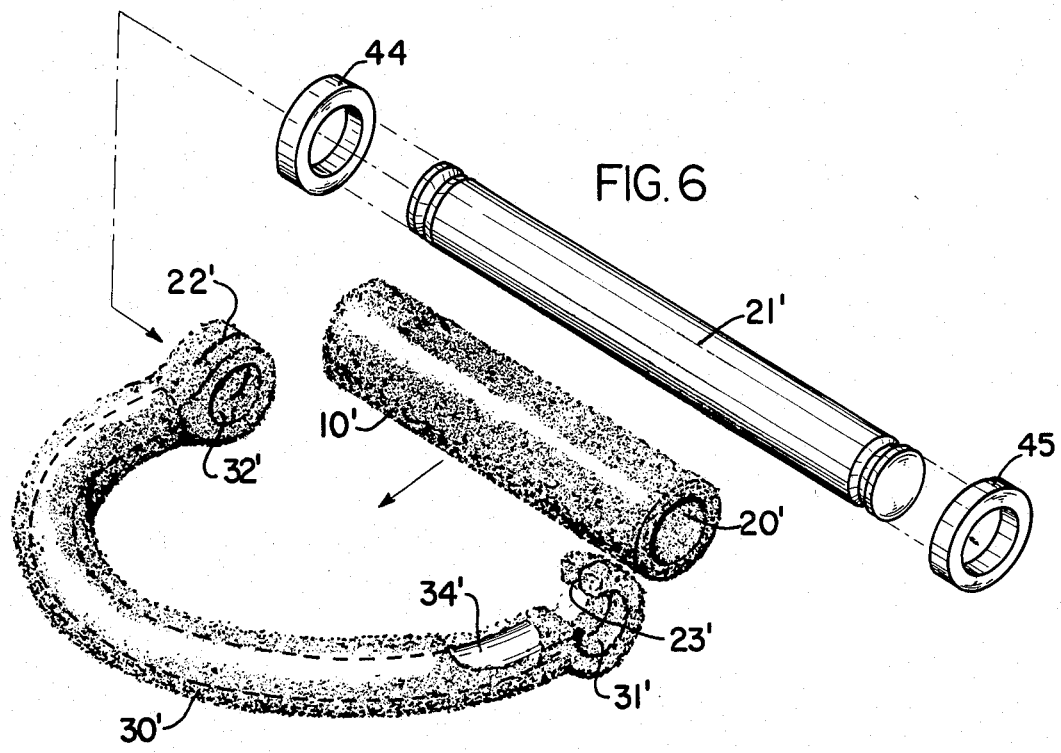
FIG. 6 is an exploded isometric view of the embodiment of the dumbbell illustrated in FIGS. 4 and 5.

In FIGS. 4, 5 and 6, I have illustrated a fourth embodiment of this invention in which I provide a grip portion in the form of a generally cylindrical resilient foam rubber or plastic body 10' having an axial bore 20' therethrough receiving an elongate rod 21' grooved at each end 22' and 23' to receive annular expansion rings 44 and 45. A curved dorsal hand strap 30' of foamed resilient rubber or plastic is provided having openings 31' and 32' at each end to pass over ends 22' and 23' and a hollow bore 33' therethrough receiving a curved metal rod 34'. The rod 34' is not connected directly to rod 21' but is free to move away due to the resilience of strap 30'. Strap 30' fits over the ends of rod 34' and is held in place by expansion rings 44 and 45.

Figure 7:
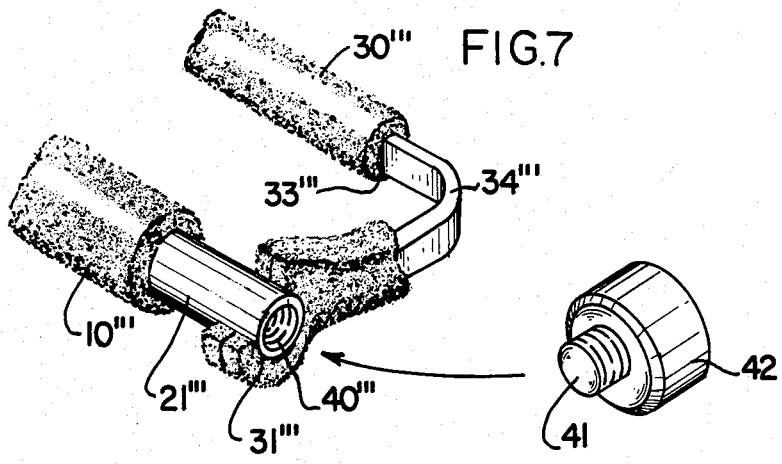
FIG. 7 is an isometric view of a fourth embodiment of this invention partly cut away and exploded.

In FIG. 7, I have illustrated an embodiment similar to that of FIGS. 1 and 2 with like parts bearing similar numbers with a triple prime sign. In this embodiment the rod 21''' may be hollow at least at the ends and provided with internal threads 40 receiving a threaded stub 41 on a weight 42.

To use the dumbbell of this invention, the user inserts the fingers of one hand through the passage 29 between cylinder 10 and strap 30, in the case of both FIGS. 1 or 4, and grasps cylinder 10 with the strap 30 behind the hand between the wrist and knuckles and with the strap portion 30 being gently urged against the back of the hand by its own resilience. In this position, the hand weight will be held on the hand with the fingers relaxed so that its use is not dependent in any way upon the continuous strength of the user's grip. A foam or spongy cellular surface aids in the frictional gripping action of the hand weight on the hand of the user, however, a closed cell foam will not absorb water, dries rapidly after "sweating" exertion and is cleanable. Either type foam may be used depending upon the preference of the user.

In the foregoing specification I have set out certain preferred practices and embodiments of my invention, however, it will be understood that this invention may be otherwise embodied within the scope of the following claims.

I claim:

1. A hand weight structure particularly adapted for aerobic and related extended-time exercises comprising an elongate rapid body member of sufficient weight for use in aerobic exercise having a surrounding soft, resilient central hand portion, where the ends of said body member extend from said central hand portion, a rigid three sided member adapted to overlay the back and sides of a hand, and a soft resilient hand engaging means surrounding said three sided member and engaging the ends of said body member at each side of said central hand portion, said hand engaging means having sufficient resilience so as to urge said rigid member toward said elongated body member thus engaging the hand between the three sided member and body member in a soft, frictional engagement.

2. A hand weight as claimed in claim 1 wherein the hand engaging means is a generally flattened D-shaped member having openings at opposite ends for engaging the ends of the hand portion and having a rigid member centrally thereof spaced from and generally parallel to the hand portion.

3. A hand weight as claimed in claim 2 wherein said hand engaging means is resilient foam.

4. A hand weight as claimed in claim 1 or 2 or 3 wherein the elongate body member is a rigid weight member having a soft resilient foam central hand portion.

5. A hand weight for aerobic and similar extended time exercises comprising a generally cylindrical elongate hand portion including an elongate weight body member and an elongate hollow resilient foam hand grip member slidably receiving the elongate weight body member where the ends of said elongated weight body member extend from said hand grip member, a hollow resilient foam hand engaging means engaged at each end on said ends of the elongate weight body member, and a generally C-shaped rigid member within said hollow hand .engaging member and spaced from the elongate weight body member, said hand engaging member having sufficient resilience so as to urge said rigid member toward said elongated weight body member thus engaging the hand between the C-shaped rigid member and the elongated weight body member in a frictional engagement.

6. A hand weight as claimed in claim 1 or 2 or 3 or 5 wherein the elongate body member is formed with a hollow end adapted to receive one of a timing device, a work load calculator, a stress measuring apparatus and the like.

7. A hand weight as claimed in claim 1 or 2 or 3 or 5 wherein the hand engaging means exerts resilient pressure on the hand of a user sufficient to hold the hand weight in place with the fingers relaxed and to maintain the users blood, circulation and pressure unaffected.

8. A hand weight as claimed in claim 1 or 2 or 3 or 5 wherein the elongate body member is adapted to receive interchangeable weights at each end.

9. A hand weight as claimed in claim 8 wherein the elongate body member is threaded at each end and the ends receive interchangeable weights, said interchangeable weights being generally cylindrical in shape having axially cooperating threaded portions.

10. A hand weight as claimed in claim 9 wherein the elongate body member is provided with external threads at each end and each interchangeable weight is provided with an axial hole threaded to receive said external threads.

11. A hand weight as claimed in claim 9 wherein the elongate body member is provided with a threaded axial opening at each end and the weights are provided with threaded axial studs threadingly entering and engaging said threaded axial opening.

* * * * *

UNITED STATES PATENT AND TRADEMARK OFFICE

CERTIFICATE OF CORRECTION

PATENT NO. : 4,627,618

DATED : December 9, 1986

INVENTOR(S) : LEONARD SCHWARTZ

It is certified that error appears in the above-identified patent and that said Letters Patent is hereby corrected as shown below:

Column 1, line 12, change "Dumbells" to --Dumbbells--.

Column 1, line 27, after "however" insert --,--.

Column 3, line 12, after "pass" insert --over--.

Column 4, line 11, claim 1, change "rapid" to --rigid--.

Signed and Sealed this

Seventeenth Day of March, 1987

*Attest:*

DONALD J. QUIGG

*Attesting Officer*

*Commissioner of Patents and Trademarks*